US005094820A

United States Patent [19]

Maxwell et al.

[11] Patent Number: 5,094,820

[45] Date of Patent: Mar. 10, 1992

[54] PUMP AND CALIBRATION SYSTEM

[75] Inventors: Thomas P. Maxwell, Santa Ana; Thomas G. Hacker, Anaheim; John W. Moers, Fallbrook, all of Calif.

[73] Assignee: Minnesota Mining and Manufacturing Company, St. Paul, Minn.

[21] Appl. No.: 514,689

[22] Filed: Apr. 26, 1990

[51] Int. Cl.[5] ..... G01N 21/00; F04B 43/08; F04B 43/12

[52] U.S. Cl. ..... 422/82.12; 422/68.1; 422/82.05; 422/102; 417/474; 417/476; 417/477

[58] Field of Search ..... 422/63, 82.12, 82.05, 422/102, 104, 68.1; 417/476, 477, 474, 475, 476, 477; 604/151, 65, 67; 128/DIG. 12, DIG. 13

[56] References Cited

U.S. PATENT DOCUMENTS

| | | | |
|---|---|---|---|
| 2,002,862 | 5/1935 | Moran | 417/476 |
| 3,109,383 | 11/1963 | Muller | 418/45 |
| 3,674,383 | 7/1972 | Iles | 417/476 |
| 3,687,580 | 8/1972 | Griffiths | 418/45 |
| 3,912,168 | 10/1975 | Mullins et al. | 239/101 |
| 3,963,023 | 6/1976 | Hankinson | 604/19 |
| 3,993,054 | 11/1976 | Newman | 128/66 |
| 4,140,118 | 2/1979 | Jassawalla | 604/123 |
| 4,336,121 | 6/1982 | Enzer et al. | 204/403 |
| 4,371,321 | 2/1983 | Koblo et al. | 418/45 |
| 4,380,236 | 4/1983 | Norton | 604/151 |
| 4,416,595 | 11/1983 | Cromie | 417/476 |
| 4,443,407 | 4/1984 | Weinberg et al. | 422/98 |
| 4,445,826 | 5/1984 | Tarr | 417/476 |
| 4,483,666 | 11/1984 | Schubert et al. | 418/45 |
| 4,493,706 | 1/1985 | Borsanyi et al. | 604/153 |
| 4,515,535 | 5/1985 | D'Silva | 417/477 |
| 4,522,571 | 6/1985 | Little | 417/476 |
| 4,537,561 | 8/1985 | Xanthopoulos | 417/477 |
| 4,559,040 | 12/1985 | Horres et al. | 417/474 |
| 4,573,884 | 3/1986 | Troutner | 417/477 |
| 4,631,007 | 12/1986 | Olson | 417/476 |
| 4,685,902 | 8/1987 | Edwards et al. | 604/153 |
| 4,705,464 | 11/1987 | Arimond | 417/477 |
| 4,758,228 | 7/1988 | Williams | 417/477 |
| 4,798,580 | 1/1989 | DeMeo et al. | 604/30 |
| 4,798,590 | 1/1989 | O'Leary et al. | 417/477 |
| 4,904,168 | 2/1990 | Cavoto et al. | 417/477 |
| 4,923,375 | 5/1990 | Ejlersen | 417/476 |
| 4,925,376 | 5/1990 | Kahler | 417/476 |

OTHER PUBLICATIONS

Soukhanov et al. Webster's II New Riverside University Dictionary; 1984; p. 341.

*Primary Examiner*—Robert J. Warden
*Assistant Examiner*—Theresa A. Trembley
*Attorney, Agent, or Firm*—Gary L. Griswold; Walter N. Kirn; Dale E. Hulse

[57] ABSTRACT

An apparatus comprising a housing, a curved wall surface on the housing and a tube compressor carried by the housing. A compressible tube, which defines at least a portion of the passage, is positioned between the curved wall surface and the tube compressor. The tube compressor is mounted on the housing for free radial movement relative to the curved wall surface and for rotational movement. The tube compressor can be releasably drivingly coupled to an external rotary input so that the tube compressor can be rolled along the tube to pump fluid in the tube.

31 Claims, 5 Drawing Sheets

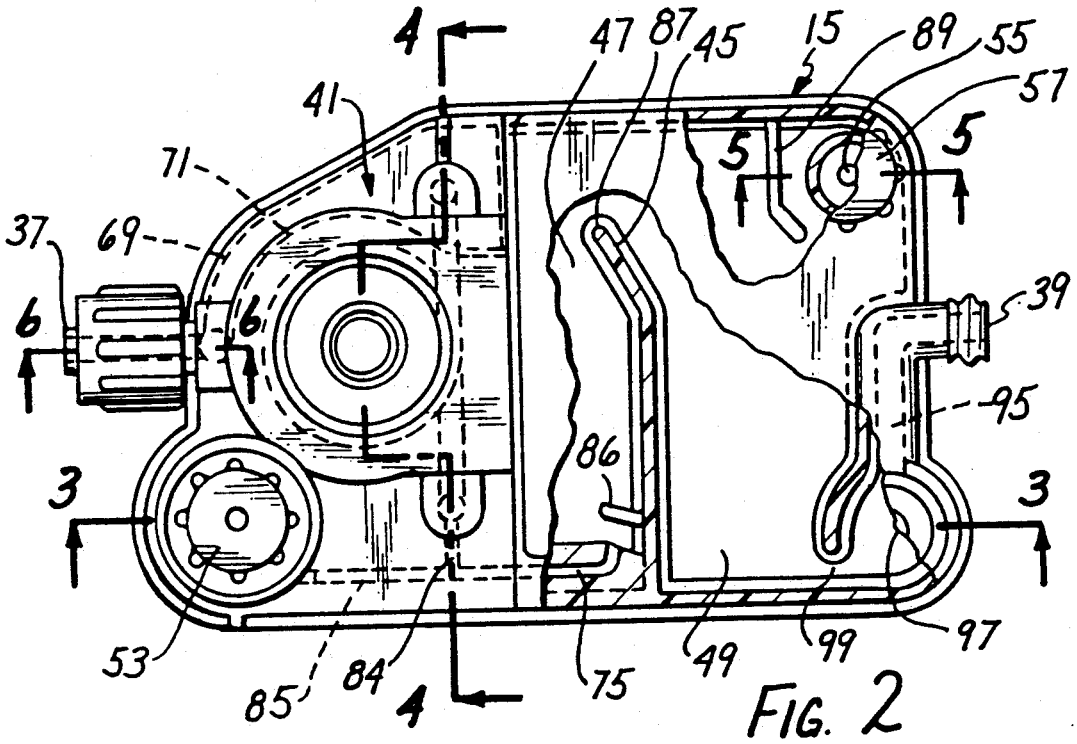
FIG. 2
FIG. 4
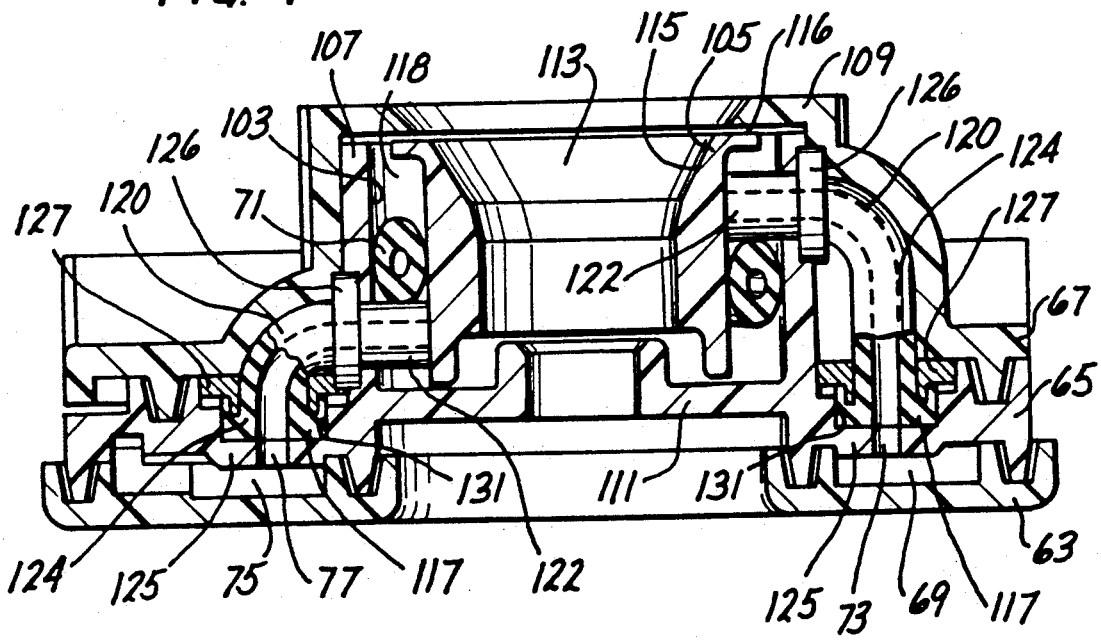

15
61
97
95
65
63
49
45
86
47
71
77
75
67
135
82
52
85
53
83
79
81
51
137
93
59
55
91
56
57
89
69
37
119
127
134
123
131
117
121
73
125
133
129

PUMP AND CALIBRATION SYSTEM

BACKGROUND OF THE INVENTION

It is often necessary or desirable to monitor various parameters of blood and to obtain quantitative data concerning such parameters in real time. In order to accomplish this, blood is caused to flow through a flow-through housing past sensors which provide signals representative of the parameters of interest. For example, Cooper U.S. Pat. No. 4,640,820 shows a flow-through housing with fluorescent sensors which respond to the partial pressure of oxygen, the partial pressure of carbon dioxide and the pH of blood which has passed through the flow-through housing.

Prior to using the flow-through housing, the sensors must be calibrated. One calibration technique, which is used for the flow-through housing and sensors shown in the Cooper patent is to immerse the flow-through housing in a calibration liquid and bubble the gas or gases of interest through the calibration liquid. A similar technique is utilized to calibrate the sensors shown in Maxwell Patent No. 4,830,013.

This calibration technique, which employs an essentially static calibration liquid, is most satisfactory when used in conjunction with a device having a flow-through passage of sufficient cross-sectional area so that the calibration liquid can readily fill all portions of the passage to fully expose the sensors to the gases carried by the calibration liquid. However, for some applications, it is desirable to utilize a flow-through housing having a relatively small cross-sectional area. In fact, the cross-sectional area is sufficiently small so that the surface tension may prevent the calibration liquid from completely filling the flow-through passage and adequately exposing the sensors to the gases in the calibration liquid. Another complicating factor is that the flow-through housing must subsequently be used for medical purposes.

These problems are solved as set forth in common assignee's application Ser. No. 07/514,704 entitled Sterile Loop Calibration System naming Thomas Maxwell and Thomas Hacker as coinventors and filed on even date herewith. According to the invention of this copending application, sterile calibration liquid is pumped through the flow-through passage.

A peristaltic pump can be used for this purpose because it will allow the calibration liquid to remain sterile. One prior art peristaltic pumping system includes a reusable component and a disposable component. The reusable component includes a motor and a rotatable cam, and the disposable component includes a cassette with a compressible tube through which the liquid to be pumped can flow. The disposable cassette can be loaded into the reusable component to enable the cam to progressively squeeze the tube to pump the liquid.

Although a system of this type does maintain sterility because the liquid being pumped is isolated from the cam, the cam is positioned to squeeze a region of the tube during storage, and this may cause the tube to take a permanent "set" and become occluded or partially occluded. In addition, it is sometimes relatively difficult to load the cassette into the reusable component because of the friction between the cam and the tube. In this regard, the tube is typically constructed of a soft, deformable material, such as silicone, and as such, the tube has a tacky or highfriction surface which inhibits sliding movement with the cam.

Horres et al U.S. Pat. No. 4,559,040 attempts to solve these problems by providing the disposable component with a movable cap so that, by appropriately angularly orienting the cam, the cam will not compress the tube during storage. Unfortunately, this construction requires precise assembly of the disposable component prior to use and precise angular indexing of the drive shaft relative to the cam in order to drivingly couple the drive shaft from the reusable component to the cam.

SUMMARY OF THE INVENTION

This invention solves these problems and provides other advantageous features. For example, this invention employs a tube compressor as part of the disposable component. The tube compressor is releasably drivingly couplable to an external rotary input of the reusable component to enable the external rotary input to move the tube compressor along a compressible tube in a way to pump fluid in the tube. No indexing of the external rotary input of the reusable component is necessary in order to drivingly couple the external rotary input to the tube compressor. Thus, a driving connection can be established regardless of the relative angular positions of the external rotary input and the tube compressor. In addition, the tube compressor does not have the tacky or high-friction characteristic of the tube, and as such, can be easily releasably, drivingly coupled to the external rotary input.

The invention can be embodied in an apparatus having pump components drivable by the external rotary input. The apparatus may comprise a housing having an inlet, an outlet and a passage extending through the housing between the inlet and the outlet. The compressible tube is carried by the housing and defines at least a portion of the passage through the housing. The housing has a curved wall surface, and the tube is between the curved wall surface and the tube compressor.

The tube compressor is mounted on the housing for free radial movement relative to the curved wall and for rotational movement. This free radial movement is in sharp contrast to the prior art in which the cam of the disposable component is mounted for rotation and is rigidly held against radial movement. This free radial movement provides a number of advantages. For example, during storage, the tube compressor is in a neutral position in which the tube is not being compressed, and accordingly, the tube does not tend to take a permanent "set" and become permanently occluded or partially occluded. In addition, the free radial movement of the tube compressor facilitates releasably coupling the tube compressor and the external rotary input. Finally, the tube compressor can be caused to roll along the tube to squeeze the tube in a zone which moves along the tube to thereby pump fluid in the tube.

Means is provided on the tube compressor for use in releasably drivingly coupling the tube compressor to the external rotary input so that the tube compressor can be rolled along the tube to pump fluid in the tube. Although such coupling means can take different forms, it preferably includes an outwardly opening cavity on the tube compressor adapted to releasably receive the external rotary input. To further facilitate mating of the rotary input with the tube compressor, the cavity preferably has a mouth which is flared radially outwardly.

Although various geometrical configurations are possible, the curved wall surface preferably circumscribes the tube compressor, and the housing has retaining surfaces for restraining the tube compressor against axial movement relative to the curved wall surface. In a preferred construction, the curved wall surface is generally cylindrical, and the tube compressor is tubular and is circumscribed by the cylindrical curved wall surface. The compressible tube is preferably wrapped at least once around the tube compressor.

The calibration technique of the copending application referred to above also requires gas injection into the calibration liquid. With this invention, gas injection is facilitated by providing a gas injection port on the housing which opens at the exterior of the housing on the same side of the housing as the releasable coupling means. The external rotary input can advantageously take the form of a rotary driving element mounted on a supporting structure of a calibration apparatus, and a gas exit port can also be provided on the supporting structure. Accordingly, when the housing is positioned on the supporting structure, the rotary driving element can be releasably coupled to the tube compressor, and the gas exit port can be placed in communication with the gas injection port. Preferably, positioning of the housing on the supporting structure or loading the housing onto the supporting structure automatically brings about these results. This in turn is made possible, in part, by the location of the coupling means and the gas injection port on the same side of the housing.

In a calibration system, it is often necessary or desirable to maintain the temperature of the calibration liquid at a predetermined level. For this purpose, the housing has a temperature-sensing location in heat exchange relationship to the passage in the cuvette, and the calibration apparatus includes a temperature sensor on the supporting structure. Here again, by positioning the sensing location on the same side of the cuvette as the coupling means and the gas injection port, the temperature sensor can be placed in close heat-transfer relationship to the temperature-sensing location when the cuvette s positioned on the supporting structure. In a preferred construction, the temperature-sensing location is in the form of a temperature well on the cuvette adapted to receive a temperature sensor, which is in the form of a temperature probe.

To facilitate providing sealed communication between the gas exit port and the gas injection port, the housing preferably has a well which surrounds the gas injection port, and the calibration apparatus includes a tube projecting from the supporting structure and defining the gas exit port. The tube is received in the well when the housing is positioned on the supporting structure. To provide a gas-tight seal for this connection, a seal is provided between the tube and the well, and preferably, the seal is on the tube so it can be reused. An important advantage of this construction is that a sealed junction between the gas exit port and the gas injection port is provided which is essentially independent of the depth of insertion of the tube into the well.

In a preferred construction, a door is mounted on the supporting structure for movement between an open position and a closed position. The door has means for releasably retaining the housing on the door, and the housing is positioned on the supporting structure in the closed position and is removed from the supporting structure in the open position. Accordingly, the housing can be easily loaded onto the supporting structure by simply moving the door to the closed position. In a preferred construction, the door pivots between the open and closed positions.

The disposable component of the calibration system, which includes the housing and the calibration loop, is provided in a package. Preferably, the door has a recess for receiving the package, with the package and recess having sufficiently complementary configurations so that the recess can at least assist in releasably retaining the package in a predetermined orientation. By tearing open the package and moving the door to the closed position, the housing is loaded into, or placed on, the supporting structure so that calibration can be carried out.

The invention, together with additional features and advantages thereof, may best be understood by reference to the following description taken in connection with the accompanying illustrative drawing.

BRIEF DESCRIPTION OF THE DRAWING

FIG. 2 is a plan view with portions broken away of a preferred form of calibration housing constructed in accordance with the teachings of this invention.

FIGS. 3 and 4 are enlarged sectional views taken generally along lines 3—3 and 4—4, respectively, of FIG. 2.

FIG. 4A is an enlarged fragmentary sectional view of a portion of FIG. 4 illustrating a preferred form of the novel seal construction of this invention.

FIG. 5 is an enlarged fragmentary sectional view taken generally along line 5—5 of FIG. 2.

FIG. 6 is an enlarged fragmentary sectional view taken generally along line 6—6 of FIG. 2.

DESCRIPTION OF THE PREFERRED EMBODIMENT

Figure 1:
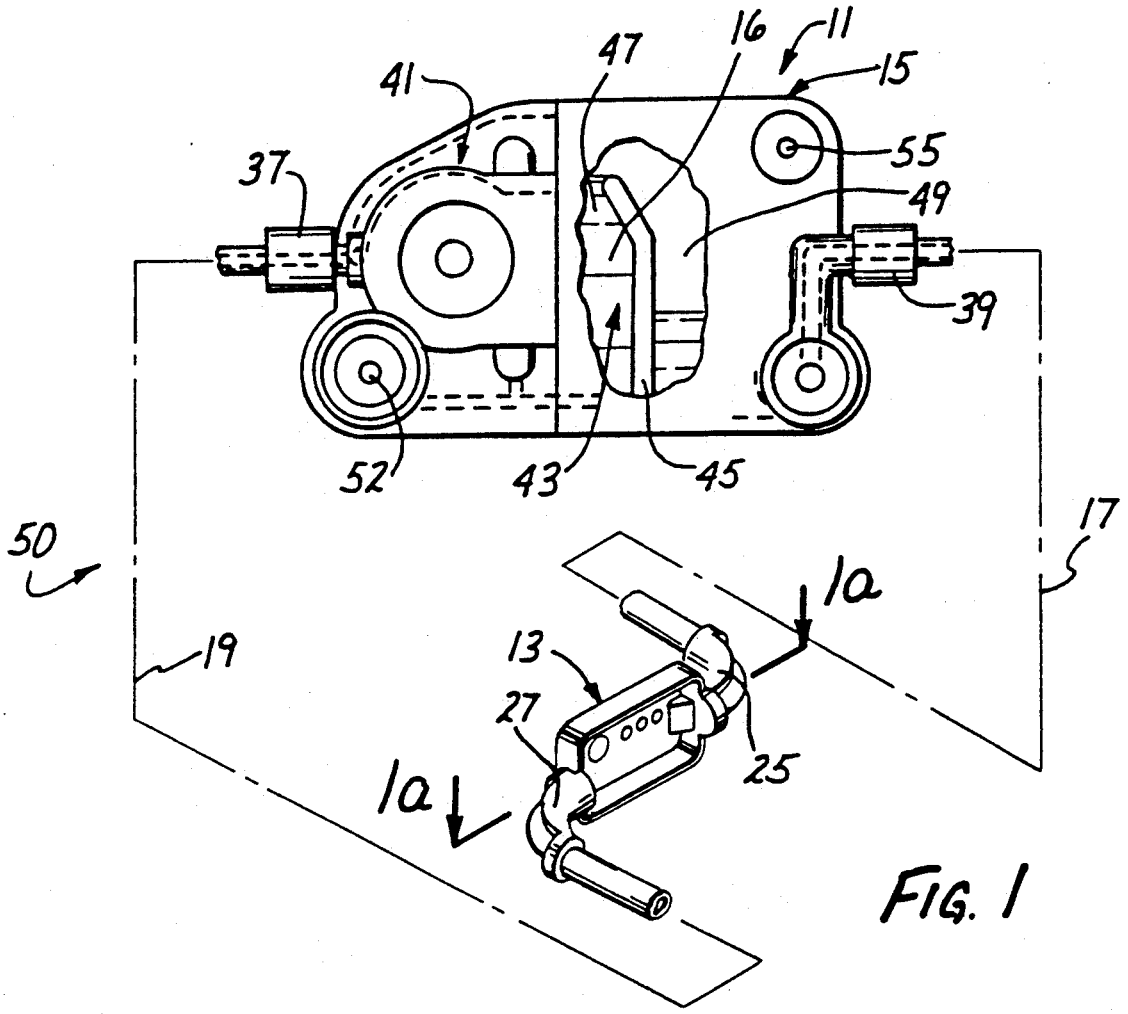
FIG. 1 is a schematic illustration of a sterile-loop calibration system constructed in accordance with the teachings of this invention.
Figure 7:
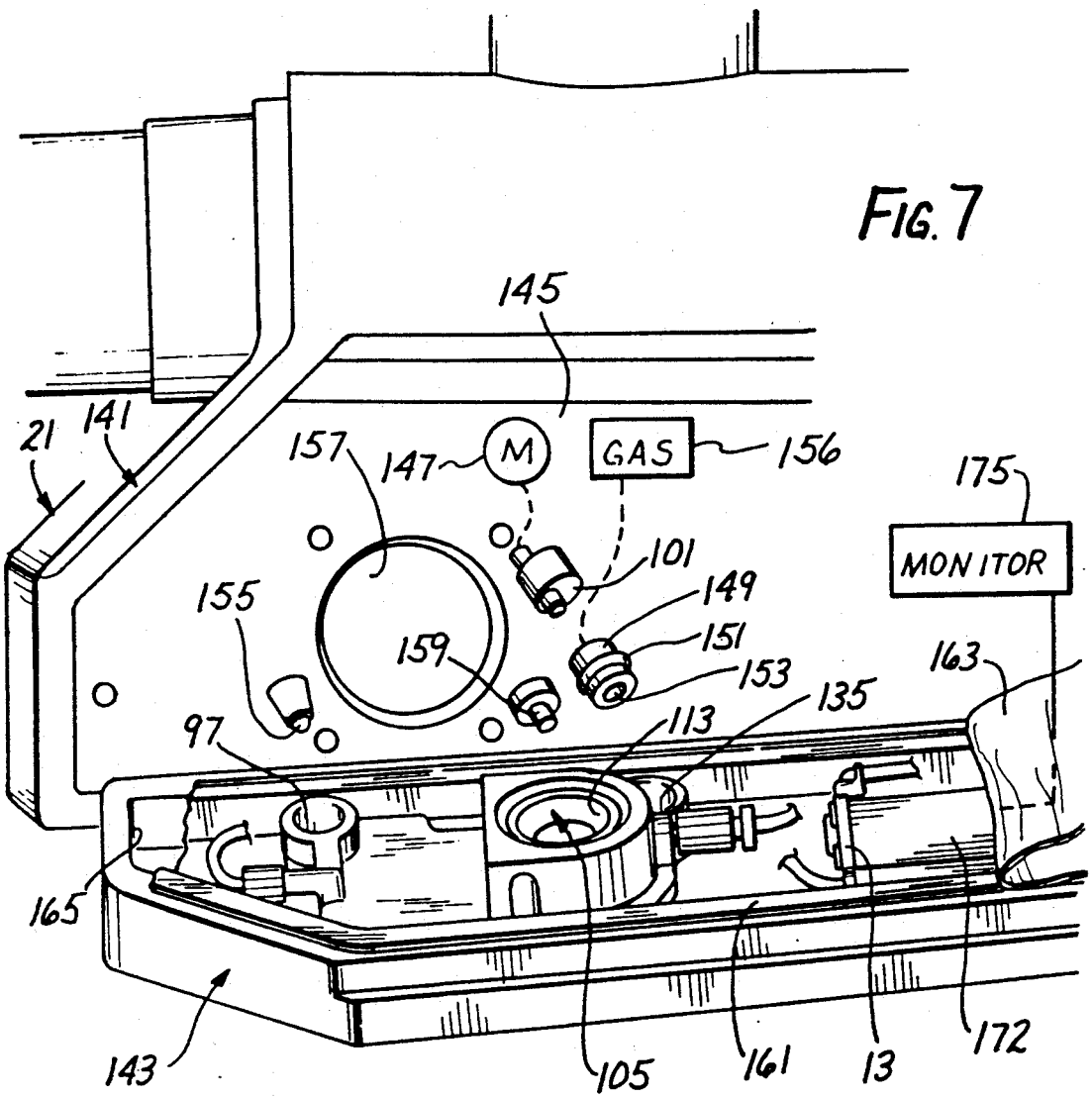
FIG. 7 is a fragmentary perspective view illustrating the calibration system and, in particular, the calibration apparatus, with the housing in a package and the door of the calibration apparatus in the open position.

FIG. 1 shows a sterile-loop calibration system 11 which generally comprises a sensor cassette 13, a calibration housing 15, sterile calibration liquid 16, and conduit means, including conduits 17 and 19, for coupling the calibration housing to the sensor cassette. Not illustrated in FIG. 1, but also included in the calibration system, is a calibration apparatus 21 (FIG. 7). The portion of the system shown in FIG. 1 is a disposable component or apparatus and is designed for use with the calibration apparatus 21, which is a reusable component.

Figure 1A:
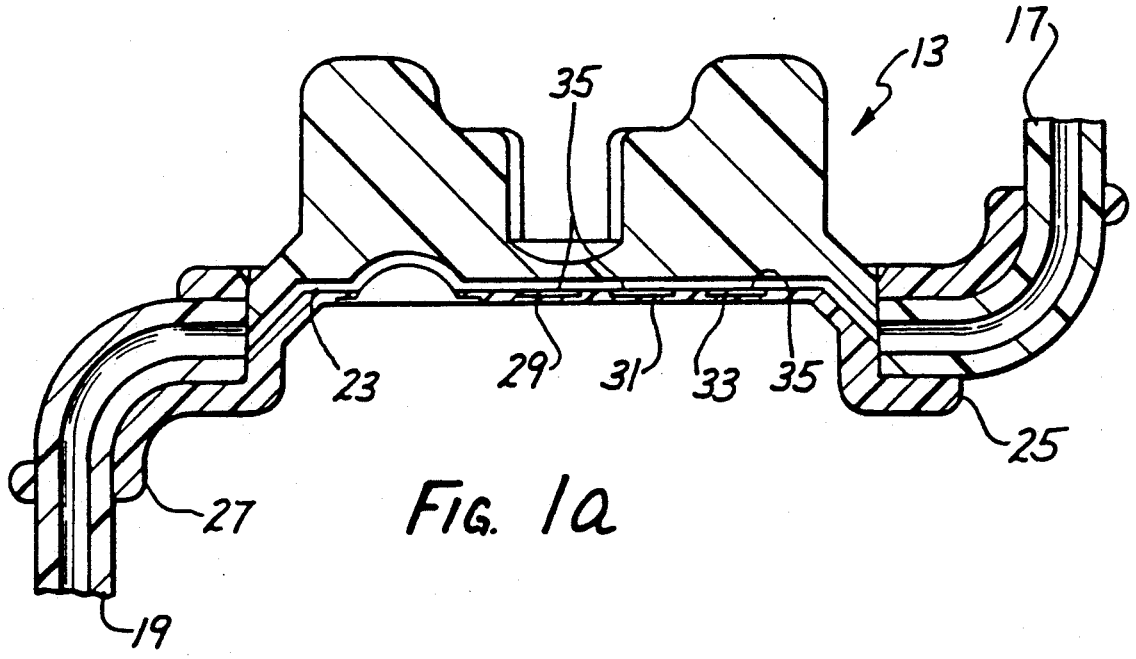
FIG. 1A is a sectional view taken generally along line 1A-1A of FIG. 1 and illustrating one form of sensor cassette.

The sensor cassette 13 may be of the type shown in common assignee's co-pending application Ser. No. 229,617 filed on Aug. 8, 1988, and entitled Intravascular Blood Gas Sensing System, which is incorporated by reference herein. Briefly however, the sensor cassette 13 includes a flow-through passage 23 (FIG. 1A) having first and second ends in the form of tube fittings 25 and 27 which are joined to the conduits 17 and 19, respectively. Sensors 29, 31 and 33, which are to be calibrated, are carried by the sensor cassette in communication with the flow-through passage 23. The sensors 29, 31 and 33 may be, for example, for sensing carbon dioxide, pH and oxygen, respectively, and each of these sensors is covered by a membrane 35 which is permeable to the constituent of interest as described in application Ser. No. 229,617 referred to above. The flow-through passage 23 has a very small cross-sectional area and may be, for example, rectangular and have dimensions of about, 0.015 inch×0.164 inch.

The calibration housing 15 (FIGS. 1 and 2) has an inlet 37, an outlet 39 and a liquid passage 41 extending through the housing from the inlet to the outlet. The liquid passage 41 includes a chamber 43, which is divided by a weir 45 or divider into a sparging chamber section 47 and a settling chamber section 49.

The flow-through passage 23, the conduits 17 and 19, and the liquid passage 41 form a sterile loop which provides an endless loop in which the sterile calibration liquid 16 can be circulated.

Figures 3, 4A, 5, 6:
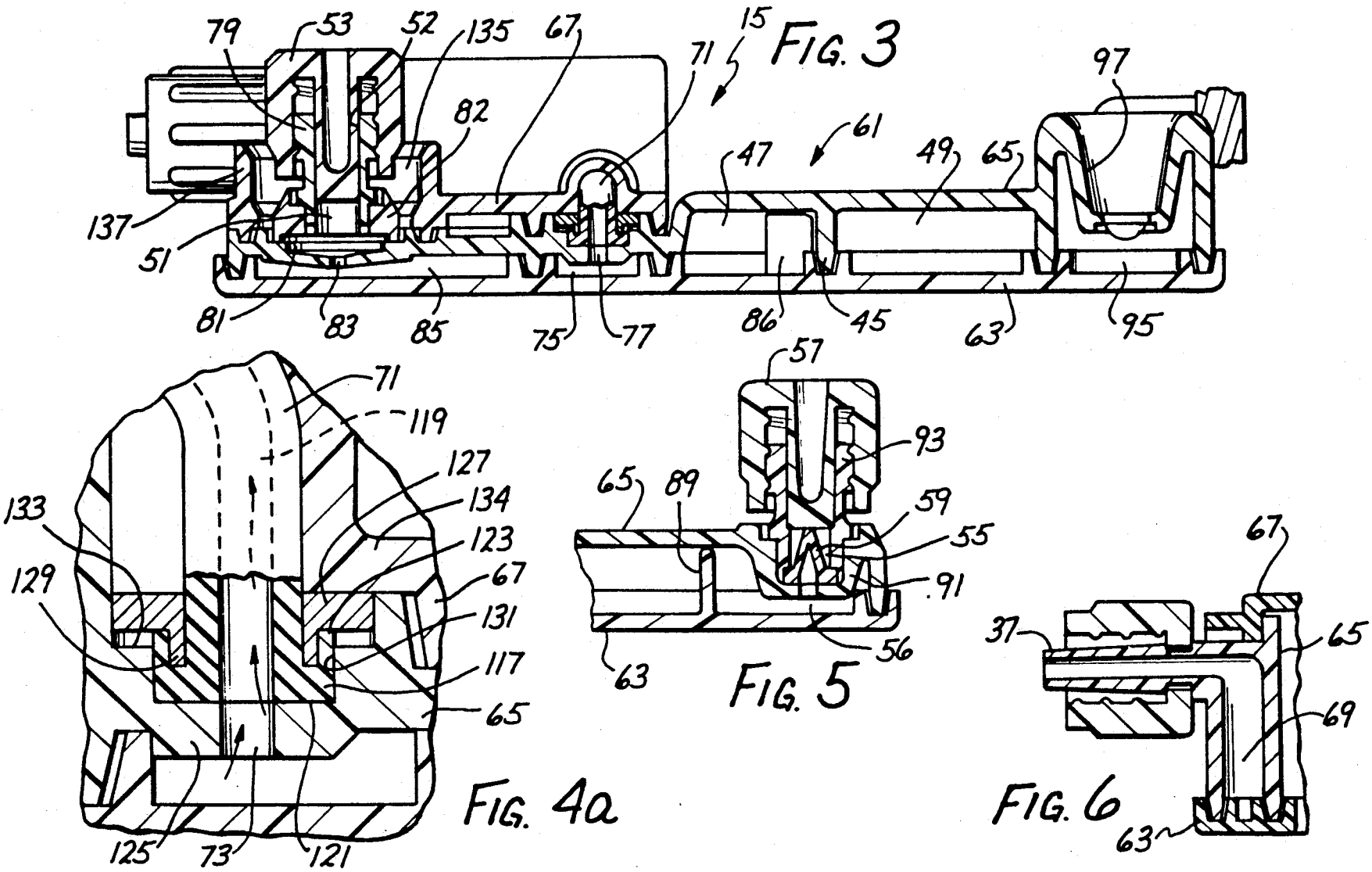

The housing 15 has a gas injection passage 51 leading from a gas injection port 52 to a location in the liquid passage 41 for injecting gas into the liquid passage and means in the form of a threaded closure cap 53 (FIGS. 2 and 3) for closing the gas-injection port. The housing 15 also includes a gas vent 55 which, in this embodiment, includes a restricted orifice 56 having, for example, a diameter of about 1/16 inch. The 55 leads from the settling chamber 49 to the exterior of the housing. The gas vent 55 may be completely closed by a closure cap 57 (FIGS. 2 and 5). A check valve 59 (FIG. 5) in the gas vent 55 allows gas to escape from the settling chamber 49 and substantially prevents gas from entering the chamber through the gas vent 55.

The construction of the housing 15 can best be understood by reference to FIGS. 2-6. Although various constructions are possible, as shown in FIG. 3, the housing 15 includes a housing 61 of multiple molded plastic components, such as a base 63, a cover 65 and a top section 67. At least the cover 65 and the top section 67 are preferably transparent. The base 63, the cover 65 and the top section 67 may be suitably coupled together as with an adhesive.

As shown in FIGS. 2 and 6, the inlet 37 leads to an inlet passage section 69 of the liquid passage 41. A radially compressible tube 71 (FIG. 4) communicates with the inlet passage section 69 through an aperture or opening 73 in the cover section 65 and with a chamber inlet section 75 (FIGS. 2 and 4) through an aperture or opening 77 (FIG. 4) which also is in the cover 65. The chamber inlet section 75 leads to the sparging chamber 47 as shown in FIG. 2.

The gas injection passage 51 (FIG. 3) is defined in part by an externally threaded tube 79 affixed to the top section 67. A gas-sterilizing filter 81 is supported on the cover 65 and retained in place by a spider section 82 of the top section 67. The gas-sterilizing filter 81 may be, for example, a .2 micron pore filter which is capable of sterilizing gas which passes through it due to the small pore size. Accordingly, with the cap 53 removed, a non-sterile gas can be introduced as described below to the injection port 52 whereby it will pass through the filter 81, an aperture 83 in the cover 65, and a passage section 85 of the gas injection passage between the base 63 and the cover 65 to the chamber inlet section 75 as shown in FIGS. 2 and 3. The chamber inlet section 75 forms a right angle (FIG. 2), and the passage section 85 enters the apex of the right angle to form a "T" 84. Thus, the gas is injected into the liquid at a location where the direction of flow of the liquid is changing. For example, the gas injected into the gas injection passage 51 may comprise $CO_2$, $O_2$ and an inert gas, such as nitrogen.

With this construction, the sterile calibration liquid 16, with the gas therein, is introduced into the sparging chamber 47. The "T" 84 provides a premixing of the gas and liquid. As shown in FIG. 2, the base 63 preferably has a baffle 86 adjacent the weir 45 and above the location where the chamber inlet section 75 opens into the sparging chamber 47 for the purpose of breaking up larger bubbles that may exist in the liquid. The sparging chamber 47 provides time for the gas to equilibrate in the calibration liquid 16, and as liquid fills the sparging chamber, it is allowed to flow over the free end 87 of the weir 45 and fall into the settling chamber 49. As gas bubbles through the calibration liquid 16 in the sparging chamber 47, foam is generated and also flows over the weir 45 into the settling chamber 49. In the settling chamber 49, any remaining gas bubbles are given another opportunity to rise to the top and be vented through the vent 55, which is in the form of an aperture in the cover 65 as shown in FIG. 5. A baffle 89 may be provided adjacent the vent 55 to reduce the likelihood that the liquid component of any foam will exit through the vent 55.

Although various constructions are possible, in the form shown in FIG. 5, the check valve 59 is conventional and is retained in a recess 91 in the cover 65 by an externally threaded tube 93 affixed to the cover. The cap 57 is threadedly attached to the tube 93.

As shown in FIG. 2, the liquid passage 41 also includes an outlet passage section 95 leading from the settling chamber 49 to the outlet 39. The housing 15 has a temperature sensing location which, in this embodiment, is in the form of a temperature well 97 adapted to receive a temperature probe in heat exchange relationship with the outlet passage section 95 as shown in FIG. 3. Although various constructions are possible, the outlet passage section 95 may communicate with the settling chamber 49 through an aperture 99 as shown in FIG. 2. The aperture 99 is positioned to force flow to occur around the temperature well 97.

In order to move the calibration liquid 16 through the sterile loop, it is necessary to provide a pump to force the calibration liquid 16 through the sterile loop 50. The pump includes pump components in the housing 15 and an external rotary input or rotary driving element 101 (FIG. 7) which is part of the calibration apparatus 21. The pump components in the housing 15 include a curved wall surface 103 (FIG. 4), the compressible tube 71 and a tube compressor 105. The opposite ends of the tube 71 form an inlet and an outlet, respectively, for the pump.

More particularly, the wall surface 103 in this embodiment is cylindrical and constitutes the inner surface of a cylindrical boss 107, portions of which are formed integrally with the cover 65 and the top section 67. The tube compressor 105 is surrounded by the wall surface 103 so as to be completely circumscribed thereby during storage of the apparatus and in use, and the tube 71 is wrapped in a circumferential direction about one time around the tube compressor and lies between the tube compressor and the wall surface 103.

The cover 65 and the top section 67 have flanges 109 and 111, respectively, which provide retaining surfaces for restraining the tube compressor 105 against axial movement relative to the wall surface 103. Because there is a radial clearance between the tube compressor 105 and the wall surface 103 and because the flanges 109 and 111 do not restrain the tube compressor against radial movement, the tube compressor is mounted on the housing for free radial movement relative to the wall surface 103 and the boss 107. In other words, the tube compressor 105 can be moved radially in any direction from the centered or neutral position shown in FIG. 4, with the only consequence being the squeezing of the compressible tube 71. With this construction, the tube compressor 105 can be caused to roll along the tube 71 to squeeze the tube in a zone which moves along the tube to thereby pump fluid in the tube. In the neutral position, the tube 71 is not squeezed.

The tube compressor 105 is generally cylindrical and tubular and has an outwardly opening cavity 113 having a mouth 115 which is flared radially outwardly to receive the rotary input 101 as described hereinbelow. Thus, the cavity 113 provides means on the tube compressor 105 for use in releasably drivingly coupling the tube compressor to the external rotary element 101 whereby the tube compressor can be rolled along the tube 71 to pump fluid in the tube. The tube compressor 105 is constructed of a suitable rigid material, such as a rigid plastic, and the cavity 113 is defined by a smooth, hard, low-friction surface which surface is smoother, harder and of substantially lower friction than the tube 71. This facilitates reception of the rotary driving element 101, which is also smooth and hard and provides a low-friction surface.

The tube compressor 105 also has an annular flange 116 at the opening of the mouth 115. The flange 116 cooperates with the flange 109 to close the upper end of a compartment 118 between the tube compressor 105 and the wall surface 103 so that the tube 71 cannot escape out the upper end of the compartment regardless of the radial position of the tube compressor 105.

The tube 71 has opposite end portions 120 having regions 122 which extend generally tangentially of the tube compressor 105 and regions 124 which extend axially of the tube compressor 105 to their respective ends. Each set of the regions 122 and 124 is integrally joined by a 90-degree bend portion. The tangential regions 122 have annular flanges 126 which are captured as shown in FIG. 4 by the boss 107 and adjacent regions of the top section 67 to thereby hold the tube 71 in position.

To prevent leakage of the sterile calibration fluid, it is important to seal the opposite ends of the tube 71 to the confronting portions of the cover 65. This can advantageously be accomplished with the seal construction shown in FIG. 4A. As shown in FIG. 4A, the tube 71 has an annular flange 117 at each end and a tube passage 119, which forms a portion of the liquid passage 41, extending longitudinally through the tube and opening at its opposite ends. The tube 71 and its flanges 117 are constructed of a resilient elastomeric material, such as silicone rubber, and as such are deformable. Each of the flanges 117 has an outer face 121 and an inner face 123.

The cover 65 has flange-supporting faces 125 surrounding the apertures 73 and 77, respectively. The outer face 121 of each of the flanges 117 engages the associated flange-supporting face 125 with the apertures 73 and 77 being in registry with the passage 119.

The tube 71 is received by a rigid clamp ring 127 of metal or rigid plastic and by a portion of the top section 67, and these members cooperate to form a tube-receiving structure which is coupled to the cover 65. The clamp ring 127 has an annular projection 129 which engages the inner face 123. The annular projection 129 is radially narrower than the inner face 123 of the flange 117 and provides high-unit loading of the flange to deform the flange. The annular projection 129 urges the flange 117 tightly against the supporting face 125 to provide a fluid-tight seal along the juncture of the tube passage 119 and the aperture 73. The top section 67, when coupled to the cover 65, urges the clamp ring 127 toward the flanges 117. As shown in FIG. 4A, the annular projection 129 deforms the flange 117 With some of the material of the flange flowing upwardly around the annular projection. In its undeformed configuration, the inner face 123, as well as the outer face 121, are planar, although a planar configuration is not required.

The cover 65 has wells 131 for receiving the flanges 117, with the flange-supporting faces 125 being at the end or bottom of the associated wells. The wells 131 open at circumscribing surfaces 133, and the clamp rings 127 are spaced from the surfaces 133, respectively. With this construction, all of the force applied to the clamp rings 127 by the top section 67 is used to deform the associated flange 117 to effect a tight seal, and none of this force is taken up by the underlying surfaces 133.

More specifically, the top section 67 has a shoulder 134 which contacts the clamp ring 127 to force it downwardly (as viewed in FIG. 4*a*) against the flange 117. The shoulder 134 contacts the clamp ring 127 around less than 360 degrees, and in the embodiment illustrated, this contact region is a little over 180 degrees. However, because the clamp ring 127 is rigid, it operates to apply a squeezing force to the flange 117 around a full 360 degrees of the flange.

As shown in FIGS. 2–4, the gas-injection port 52, the temperature well 97 and the tube compressor 105 all open at the exterior of the housing on the same side of the housing. In addition, the housing 15 has a well 135 defined by an upstanding annular boss 137, and the well also opens on the same side of the housing. The well 135 surrounds the gas-injection port 52.

Figure 8:
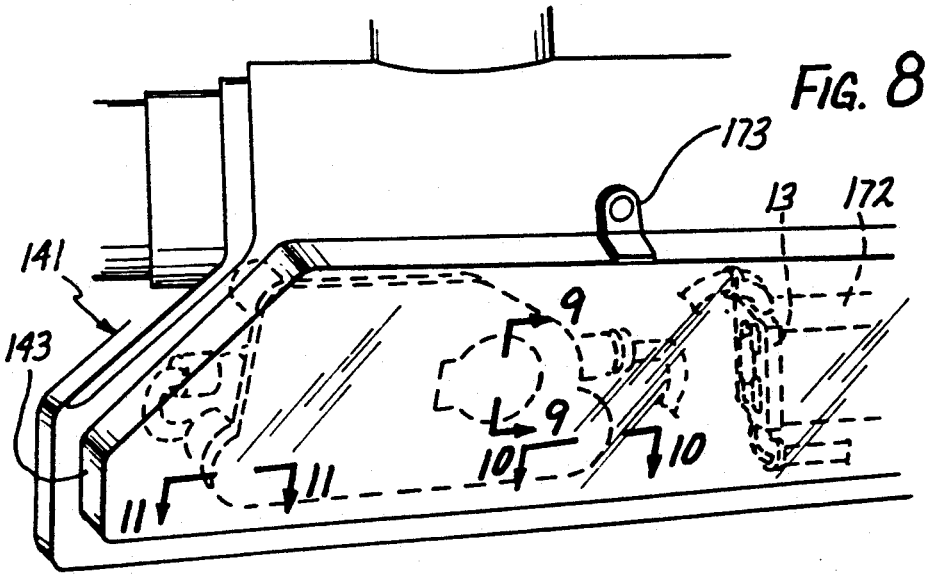
FIG. 8 is a perspective view similar to FIG. 7, with the door in the closed position.
Figure 9:
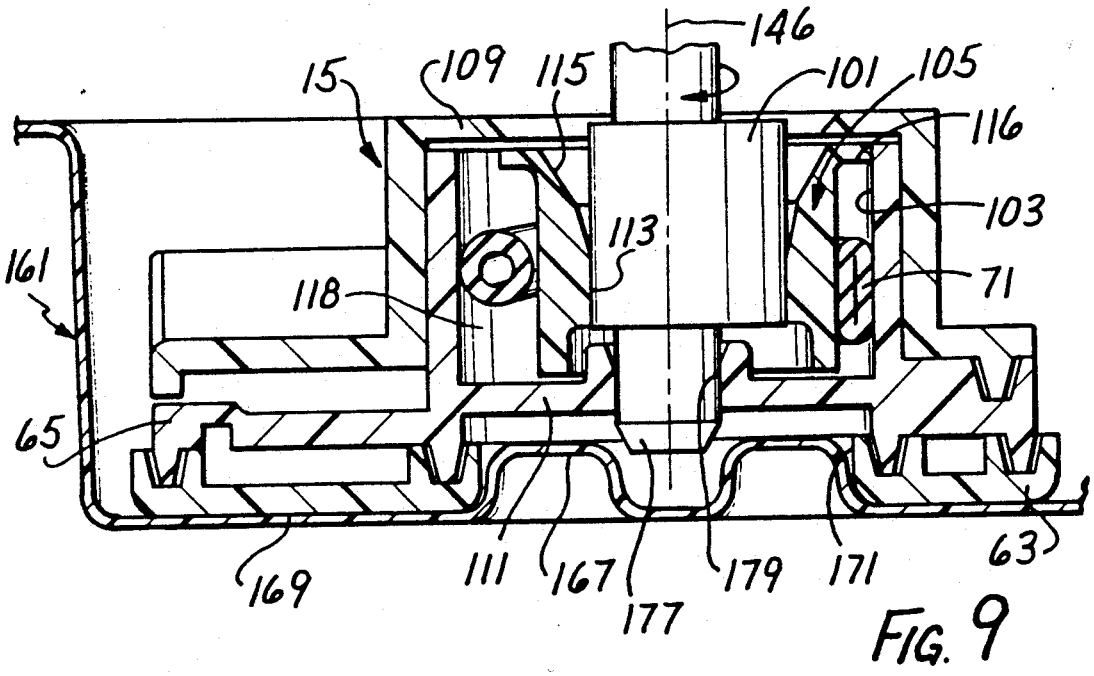
FIGS. 9, 10 and 11 are enlarged fragmentary sectional views taken generally along lines 9—9, 10—10 and 11—11, respectively, of FIG. 8.

The calibration apparatus 21 includes a supporting structure 141 and a door 143 pivotally mounted on the supporting structure for movement between an open position shown in FIG. 7 and a closed position shown in FIG. 8. The rotary driving element 101 is rotatably mounted on the supporting structure 141 and projects outwardly from a front surface 145 thereof. The rotary driving element 101 is an eccentrically mounted cam which is rotatable about an axis 146 (FIG. 9). In this embodiment, the rotary driving element 101 is driven by a suitable motor 147, which is also carried by the supporting structure 141. The rotary driving member 101 serves as a cam to move the tube compressor 105 to bring about a pumping action in the tube 71.

A tube 149 carrying an annular seal 151 and defining a gas exit port 153 is mounted on the supporting structure 141 and projects outwardly from the front surface 145 in the same direction as the rotary driving element 101. A temperature sensor in the form of a temperature probe 155 is also mounted on the supporting structure 141 and projects outwardly from the front surface 145 in the same direction as the rotary driving element 101. The tube 149 is coupled to a source 156 of calibration gas, which also may be carried by the supporting structure 141. The temperature probe 155 may be coupled to an appropriate temperature read out (not shown) and/or to a circuit for controlling a heat lamp 157 which is carried by the supporting structure 141 and faces outwardly from the front surface 145 in the same direction as the rotary driving element 101. The heat lamp 157 is provided for the purpose of maintaining the calibration liquid 16 at the desired temperature, such as 37 degrees C.

A spring-biased ejector 159 is mounted on the supporting structure 141 and projects outwardly from the front surface 145. When the housing 15 is positioned on the supporting structure 141 as described below and the door is in the closed position of FIG. 8, the ejector 159 applies a resilient force to the housing to urge the door toward the open position of FIG. 7.

The entire disposable component of the system 11 as shown in FIG. 1 is carried in an openable package 161 (FIGS. 7 and 9). The package 161 includes a cover 163 which can be peeled back as shown in FIG. 7 to expose the portions of the system 11 carried by the package. The door 143 has a recess 165 for receiving the package 161. The package 161 and the recess 165 have sufficiently complementary configurations so that the recess can at least assist in releasably retaining the package in a predetermined orientation. The housing 15 is retained within the package 161 in a predetermined orientation by a projection 167 in a bottom wall 169 of the package 161 and a mating recess 171 (FIG. 9) in the housing.

In use, the cover 163 is peeled back from the remainder of the package 161, and the package is placed in the recess 171 of the door 143 as shown in FIG. 7. An optical head 172 is coupled to the sensor cassette 13 in a known manner optically to couple the sensors 29, 31 and 33 to an instrument or monitor 175. The closure caps 53 and 57 are removed to expose the gas injection port 52 and the gas vent 55, respectively. The door 143 is then pivoted from the open position of FIG. 7 to the closed position of FIG. 8, and the door is retained in the closed position by a suitable lock 173.

Placing the door 143 in the closed position positions the housing on the supporting structure 141. When so positioned, the rotary driving element 101, the tube 149 and the temperature probe 155 are received in the cavity 113, the well 135 and the temperature well 97, respectively, and this results automatically from simply closing the door, i.e., moving the door to the closed position. In addition, the ejector 159 is resiliently compressed against a region of the housing 15 so that the ejector resiliently loads the door 143 toward the open position of FIG. 7.

The flared mouth 115 serves as a cam follower or lead in as the rotary driving element 101 is inserted into the cavity 113. Specifically, the rotary driving element 101 cooperates with the flared mouth 115 to cam the tube compressor 105 radially to the position shown, by way of example, in FIG. 9 in which one side of the tube 71 is tightly squeezed between the tube compressor and the curved wall surface 103, and the other side of the tube 71 is uncompressed.

The rotary driving element 101 has a nose 177 (FIG. 9) which is received in a bearing 179 when the door is in the closed position.

It will be appreciated that the tube compressor 105 is in the neutral position during storage of the housing 15 and at all times when the rotary driving element 101 is not received within the tube compressor 105 as shown in FIG. 9. Consequently, the tube 71 is normally not compressed, or significantly compressed. Consequently, there is no danger of the tube 71 taking a "set" or becoming occluded as a result of compression of the tube during storage. Because the tube compressor 105 is free to move radially inside the curved wall surface 103, eccentric rotation of the rotary driving element 101 about the axis 146 (FIG. 9) causes the tube compressor 105 to roll along the tube to create a peristaltic pumping action to pump the calibration liquid 16 through the sterile loop 50 including the flow-through passage 23 of the housing 15. Because the surfaces defining the cavity 113 and the exterior of the rotary driving element 101 are relatively hard, smooth and of low friction, the insertion of the rotary driving element 101 into the cavity 113 is easily accomplished by simply closing the door 143 even though a camming action and consequent radial movement of the tube compressor 105 must occur.

It should be noted that no angular indexing of the rotary driving element 101 is necessary in order to insert the rotary driving element into the cavity 113 of the tube compressor 105. Thus, driving engagement can be established between the rotary driving element 101 and the tube compressor 105 automatically as a result of moving the door 143 to the closed position and regardless of the angular orientation of the rotary driving element 101.

Figure 10:
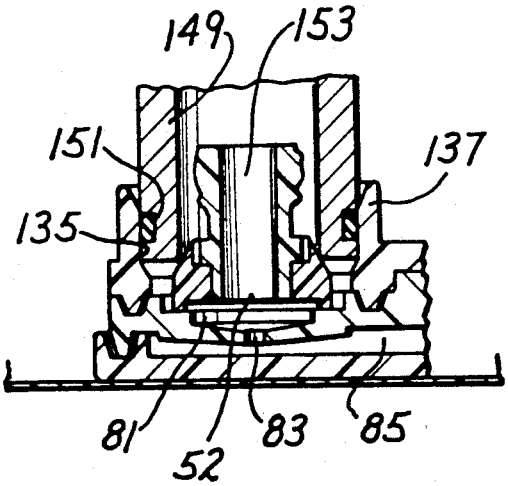
Figure 11:
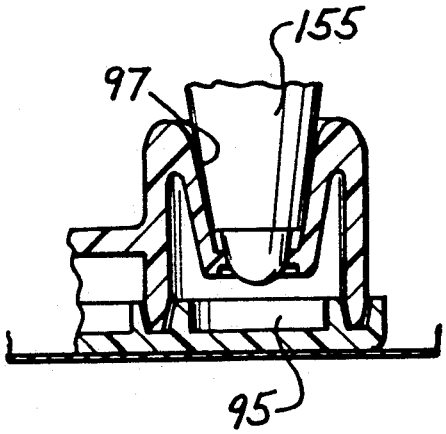

The closing of the door 143 also inserts the tube 149 into the well 135 to place the gas exit port 153 in communication with the gas injection port 52 as shown in FIG. 10. The seal 151 cooperates with the well 135 to maintain a gas-tight seal between the tube 149 and the boss 137 over a range of insertion depths. Consequently, gas can be supplied from the gas source 156 through the gas exit port 153, the gas injection port 52, the passage section 85 (FIG. 2) to the chamber inlet section 75 at the "T" 84. The gas is supplied at some positive pressure, and consequently, the pressure in the liquid passage 41 is greater than ambient. For this reason, gas vents from the gas vent 55, and the positive pressure existing in the liquid passage 41 and the flow of gas outwardly inhibits inward flow of gas or liquid through the gas vent 55 into the liquid passage 41. At the "T" 84, the gas is introduced into the stream of calibration liquid 16 being circulated by the pump and is premixed with the liquid for introduction into the sparging chamber 47. The gas is sterilized by the filter 81 so that sterile gas is introduced into the sterile calibration liquid 16. Gas which vents from the vent 55 can escape from within the calibration apparatus 21.

In the closed position of the door 143, the temperature probe 155 is received within the well 97 so that temperature readings can be taken of the liquid in the outlet passage section 95. In addition, the heat lamp 157 is placed in close proximity with the housing 15 so that the calibration liquid 16 can be heated to the desired temperature.

When the partial pressures of the gases of interest reach the desired level in the calibration liquid 16, the monitor 175, is calibrated to the particular sensor cassette 13 and, particularly, the sensors 29, .31 and 33 thereof using conventional techniques. Thereafter, lock 173 is unlocked, and the door 143 is pivoted to the open position by the ejector 159 to remove the housing 15 from the calibration apparatus 21. The sensor cassette 13 can be employed with the monitor 175 for the measurement of the relevant blood parameters of interest of a patient as disclosed, for example, in application Ser. No. 229,617 referred to above.

Although an exemplary embodiment of the invention has been shown and described, many changes, modifications and substitutions may be made by one having ordinary skill in the art without necessarily departing from the spirit and scope of this invention.

We claim:

1. An apparatus having pump components drivable by an external rotary input, said apparatus comprising:

a housing having an inlet, an outlet, and a passage extending through the housing between the inlet and the outlet;

a tube compressor;

a curved wall surface on the housing which completely circumscribes said tube compressor during storage of the apparatus;

a compressible tube carried by said housing and defining at least a portion of said passage, said tube being between the curved wall surface and the tube compressor and being in an uncompressed state during storage of the apparatus;

means for mounting the tube compressor on the housing for free radial movement relative to the curved wall surface and for rotational movement whereby the tube compressor can be caused to roll along the tube to squeeze the tube in a zone which moves along the tube to thereby pump fluid in the tube, said mounting means serving to position said tube compressor in a neutral position during storage such that said tube is not compressed by said tube compressor during storage; and means on the tube compressor for use in releasably drivingly coupling the tube compressor to the external rotary input whereby the tube compressor can be rolled along the tube to pump fluid in the tube.

2. An apparatus as defined in claim 1 wherein the coupling means includes an outwardly opening cavity on the tube compressor adapted to releasably receive the external rotary input.

3. An apparatus as defined in claim 2 wherein the cavity has a mouth which is flared radially outwardly.

4. An apparatus as defined in claim 1 wherein the curved wall surface is generally cylindrical and the tube compressor is tubular, said compressible tube being wrapped at least once around the tube compressor.

5. An apparatus as defined in claim 1 wherein the housing has retaining surfaces for restraining the tube compressor against axial movement relative to the curved wall surface.

6. An apparatus as defined in claim 1 wherein the housing has a gas injection passage leading from a gas injection port on the housing to the passage through the housing, said gas injection port opening at the exterior of the housing on one side of the housing and said coupling means being on said side of the housing.

7. An apparatus as defined in claim 6 wherein the housing has a well on said one side of the housing which surrounds the gas injection port.

8. An apparatus as defined in claim 1 wherein the housing has a temperature well adapted to receive a temperature probe, said temperature well opening at the exterior of the housing on one side of the housing and said coupling means being on said side of the housing.

9. An apparatus as defined in claim 8 wherein the coupling means includes a cavity opening outwardly on said one side of the housing and the housing has a gas injection passage leading from a gas injection port to the passage in the housing, said gas injection port opening on said one side of the housing.

10. An apparatus as defined in claim 2 including an annular flange on one end of the tube compressor.

11. An apparatus as defined in claim 5 wherein the coupling means includes an outwardly opening cavity on the tube compressor adapted to releasably receive the external rotary input, the cavity has a mouth and an annular flange on one end of the tube compressor which confronts one of the retaining surfaces and which is adjacent said mouth.

12. A system comprising:

a housing having an inlet, an outlet, and a passage extending through the housing between the inlet and the outlet;

a tube compressor;

a curved wall surface on the housing which completely circumscribes said tube compressor during storage of the system;

a compressible tube carried by said housing and defining at least a portion of said passage, said tube being between the curved wall surface and the tube compressor and being in an uncompressed state during storage of the system;

means for mounting the tube compressor on the housing for free radial movement relative to the curved wall surface and for rotational movement, said mounting means serving to position said tube compressor in a neutral position during storage such that said tube is not compressed by said tube compressor during storage;

a supporting structure;

a rotary driving element mounted for rotation on the supporting structure;

said housing being positionable on the supporting structure and removable therefrom; and means for releasably drivingly coupling the rotary driving element and the tube compressor when the housing is positioned on the supporting structure so the tube compressor can be rolled along the tube to pump fluid in the tube.

13. A system as defined in claim 12 including a gas exit port on the supporting structure and a gas injection passage in the housing leading from a gas injection port on the housing to the passage through the housing, said gas exit port and said gas injection port being in communication when the housing is positioned on the supporting structure.

14. A system as defined in claim 13 wherein the housing has a well surrounding the gas injection port and the apparatus includes a tube projecting from the supporting structure and defining the gas exit port, said tube being received in said well when the housing is positioned on the supporting structure and the system includes a seal between the tube and the well.

15. A system as defined in claim 12 wherein the housing has a temperature-sensing location in heat exchange relationship to said passage in the housing and the apparatus includes a temperature sensor on the supporting structure, said temperature sensor being in close heat-transfer relationship to the temperature-sensing location when the housing is positioned on the supporting structure.

16. A system as defined in claim 15 including a gas exit port on the supporting structure and a gas injection passage in the housing leading from a gas injection port on the housing to the passage through the housing, said gas exit port and said gas injection port being in communication when the housing is positioned on the supporting structure.

17. A system as defined in claim 12 including a door and means for mounting the door on the supporting structure for movement between an open position and a closed position, and means on the door for releasably retaining the housing on the door, said housing being positioned on the supporting structure in said closed position and removed from the supporting structure in said open position.

18. A system as defined in claim 17 wherein the means for mounting the door pivots the door between the open and closed positions.

19. A system as defined in claim 17 including a package, said housing being in said package, said door having a recess for receiving said package, said package and said recess having sufficiently complementary configurations so that the recess can at least assist in releasably retaining the package in a predetermined orientation.

20. A calibration system comprising:

a sensor cassette having a flow-through passage and including at least one sensor to be calibrated;

a calibration housing having a liquid passage;

conduit means for interconnecting said passages;

a calibration liquid in the liquid passage;

a wall surface on the housing;

a tube compressor;

said liquid passage including a compressible tube between the wall surface and the tube compressor;

means for mounting the tube compressor on the housing for movement relative to the wall surface to squeeze the tube in a zone which moves along the tube whereby fluid can be pumped in the tube;

said housing having a gas injection passage leading from a gas injection port on the housing to the liquid passage;

a calibration apparatus including a supporting structure, a rotary driving element mounted for rotation on the supporting structure and a gas exit port on the supporting structure;

said housing being positionable on the supporting structure to place the rotary driving element and the tube compressor in driving engagement and the gas exit port and the gas injection port in communication whereby the calibration liquid can be pumped and gas can be supplied to the liquid passage; and the housing being removable from the supporting structure to place the rotary driving element and tube compressor out of driving engagement and said ports out of communication.

21. A system as defined in claim 20 wherein the housing has a well surrounding the gas injection port and the calibration apparatus includes a tube projecting from the supporting structure and defining the gas exit port, said tube being received in said well when the housing is positioned on the supporting structure and the system includes a seal between the tube and the well.

22. A system as defined in claim 20 wherein the housing has a temperature-sensing location in heat-exchange relationship to said liquid passage and the apparatus includes a temperature sensor on the supporting structure, said temperature sensor being in close heat-transfer relationship to the temperature-sensing location when the housing is positioned on the supporting structure.

23. A system as defined in claim 20 including a door and means for mounting the door on the supporting structure for movement between an open position and a closed position, means on the door for releasably retaining the housing on the door, said housing being positioned on the supporting structure in said closed position and removed from the supporting structure in said open position.

24. A system as defined in claim 20 wherein said mounting means serves to position said tube compressor in a neutral position during storage such that said tube is not compressed by said tube compressor during storage.

25. An apparatus having pump components drivable by an external rotary input, said apparatus comprising:

a housing having an inlet, an outlet, and a passage extending through the housing between the inlet and the outlet;

a curved wall surface on the housing;

a tube compressor;

a compressible tube carried by said housing and defining at least a portion of said passage, said tube being between the curved wall surface and the tube compressor;

means for mounting the tube compressor on the housing for free radial movement relative to the curved wall surface and for rotational movement whereby the tube compressor can be caused to roll along the tube to squeeze the tube in a zone which moves along the tube to thereby pump fluid in the tube; and means on the tube compressor for use in releasably drivingly coupling the tube compressor to the external rotary input whereby the tube compressor can be rolled along the tube to pump fluid in the tube;

wherein the housing has a gas injection passage leading from a gas injection port on the housing to the passage through the housing, said gas injection port opening at the exterior of the housing on one side of the housing and said coupling means being on said side of the housing.

26. An apparatus as defined in claim 25 wherein the housing has a well on said one side of the housing which surrounds the gas injection port.

27. A system comprising:

a housing having an inlet, an outlet, and a passage extending through the housing between the inlet and the outlet;

a curved wall surface on the housing;

a tube compressor;

a compressible tube carried by said housing and defining at least a portion of said passage, said tube being between the curved wall surface and the tube compressor;

means for mounting the tube compressor on the housing for free radial movement relative to the curved wall surface and for rotational movement;

a supporting structure;

a rotary driving element mounted for rotation on the supporting structure;

said housing being positionable on the supporting structure and removable therefrom;

means for releasably drivingly coupling the rotary driving element and the tube compressor when the housing is positioned on the supporting structure so the tube compressor can be rolled along the tube to pump fluid in the tube; and a gas exit port on the supporting structure and a gas injection passage in the housing leading from a gas injection port on the housing to the passage through the housing, said gas exit port and said gas injection port being in communication when the housing is positioned on the supporting structure.

28. A system as defined in claim 27 wherein the housing has a well surrounding the gas injection port and the apparatus includes a tube projecting from the supporting structure and defining the gas exit port, said tube being received in said well when the housing is positioned on the supporting structure and the system includes a seal between the tube and the well.

29. A system comprising:

a housing having an inlet, an outlet, and a passage extending through the housing between the inlet and the outlet;

a curved wall surface on the housing;

a tube compressor;

a compressible tube carried by said housing and defining at least a portion of said passage, said tube being between the curved wall surface and the tube compressor;

means for mounting the tube compressor on the housing for free radial movement relative to the curved wall surface and for rotational movement;

a supporting structure;

a rotary driving element mounted for rotation on the supporting structure;

said housing being positionable on the supporting structure and removable therefrom;

means for releasably drivingly coupling the rotary driving element and the tube compressor when the housing is positioned on the supporting structure so the tube compressor can be rolled along the tube to pump fluid in the tube; and a door and means for mounting the door on the supporting structure for movement between an open position and a closed position, and means on the door for releasably retaining the housing on the door, said housing being positioned on the supporting structure in said closed position and removed form the supporting structure in said open position.

30. A system as defined in claim 29 wherein the means for mounting the door pivots the door between the open and closed positions.

31. A system as defined in claim 29 including a package, said housing being in said package, said door having a recess for receiving said package, said package and said recess having sufficiently complementary configurations so that the recess can at least assist in releasably retaining the package in a predetermined orientation.

* * * * *

UNITED STATES PATENT AND TRADEMARK OFFICE

CERTIFICATE OF CORRECTION

PATENT NO. : 5,094,820

DATED : March 10, 1992

INVENTOR(S) : Maxwell et al.

It is certified that error appears in the above-identified patent and that said Letters Patent is hereby corrected as shown below:

Col. 1, line 39, after "must", please insert --be kept sterile during calibration so that it can--

Col. 3, line 33, "cuvette" should be --housing--

Col. 3, line 36, "cuvette" should be --housing--

Col. 3, lines 39-40, "cuvette s" should be --housing is--

Col. 3, line 42, "cuvette" should be --housing--

Col. 5, line 30, after "The" insert --gast vent--

Col. 16, line 17, "form" should be --from--

Signed and Sealed this

Thirteenth Day of July, 1993

*Attest:*

Michael K. Kirk

MICHAEL K. KIRK

*Attesting Officer*

*Acting Commissioner of Patents and Trademarks*